United States Patent [19]

Loevinger

[11] Patent Number: 4,476,788

[45] Date of Patent: Oct. 16, 1984

[54] HEATED RAILROAD TANK CAR

[76] Inventor: Richard Loevinger, P.O. Box 68, Brandon, S. Dak. 57005

[21] Appl. No.: 454,537

[22] Filed: Dec. 30, 1982

Related U.S. Application Data

[63] Continuation-in-part of Ser. No. 385,869, Jun. 7, 1982.

[51] Int. Cl.[3] ..... B61D 5/00; B61D 27/00; F24H 9/16

[52] U.S. Cl. ..... 105/451; 29/157.3 R; 29/157.4; 105/358; 126/378; 165/169; 296/184

[58] Field of Search ..... 15/246.5; 29/157.3 R, 29/157.4, 401.1, 469; 126/343.5 A, 378, 443.5 R; 165/41, 169; 280/5 G, 5 C, 5 D, 5 E; 296/184; 432/13; 105/247, 358, 360, 451

[56] References Cited

U.S. PATENT DOCUMENTS

| | | | |
|---|---|---|---|
| 1,706,084 | 3/1929 | Steinmeyer et al. | 126/343.5 A |
| 2,145,614 | 1/1939 | Stambaugh | 105/247 X |
| 2,545,371 | 3/1951 | Mojounier et al. | 165/169 X |
| 2,558,648 | 6/1951 | Gausmann | 105/358 |
| 2,624,553 | 1/1953 | Thompson et al. | 126/343.5 A |
| 2,772,784 | 12/1956 | Cyphers et al. | 15/246.5 |
| 3,143,108 | 8/1964 | Rogers | 126/378 X |
| 3,176,764 | 4/1965 | Barbera | 105/451 X |
| 3,228,466 | 1/1966 | Carleton | 105/451 X |
| 3,255,517 | 6/1966 | Barbera | 29/469 X |
| 3,479,724 | 11/1969 | Kruizenga et al. | 29/469 X |
| 3,503,381 | 3/1970 | Role | 126/343.5 A |
| 3,595,307 | 7/1971 | Mowatt-Larssen | 165/169 X |
| 3,685,458 | 8/1972 | Price et al. | 105/451 X |
| 3,742,866 | 7/1973 | Needham et al. | 105/360 |

*Primary Examiner*—Howard Beltran

[57] ABSTRACT

A heated tank such as in a railroad tank car has a heat exchanger spaced from the bottom of the car to define a dead air space to insulate the heat exchanger from the bottom. The heat exchanger extends substantially longitudinally and transversely across the entire bottom of the car to provide a large heating transfer surface to the lading supported by the exchanger. A portion of the exchanger substantially encompasses a discharge valve of the tank car to provide heat transfer to the valve during unloading. The heat exchanger slopes toward the discharge valve to facilitate total removal of the lading. An inlet and an outlet associated with the heat exchanger are disposed adjacent the discharge valve for additional transfer of heat to the discharge valve. Baffles in the heat exchanger define a plurality of serpentine passages for conducting a heating medium. Feeder lines interconnect a central passage with outermost passages for introducing a portion of the heating medium in the outlying passages to obtain more uniform heating across the surface of the heat exchanger. The feeder lines serve to return a portion of the condensate to the central passage to avoid build-up of the condensate. A modified heat exchanger also includes a series of ports at a downwardly sloped end for purging condensate forming in the passages. The purged condensate is discharged through an outlet which is situated away from the inlet so as not to sap incoming heat.

53 Claims, 14 Drawing Figures

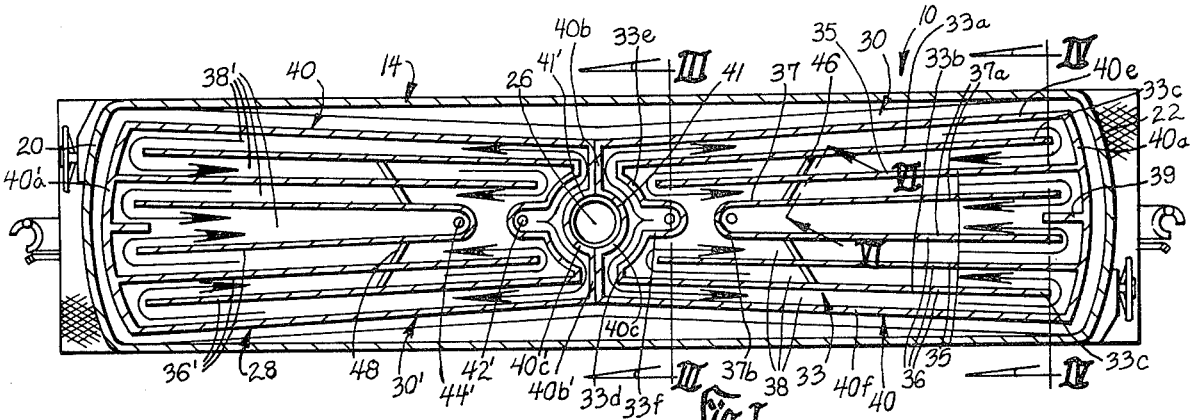
Fig I
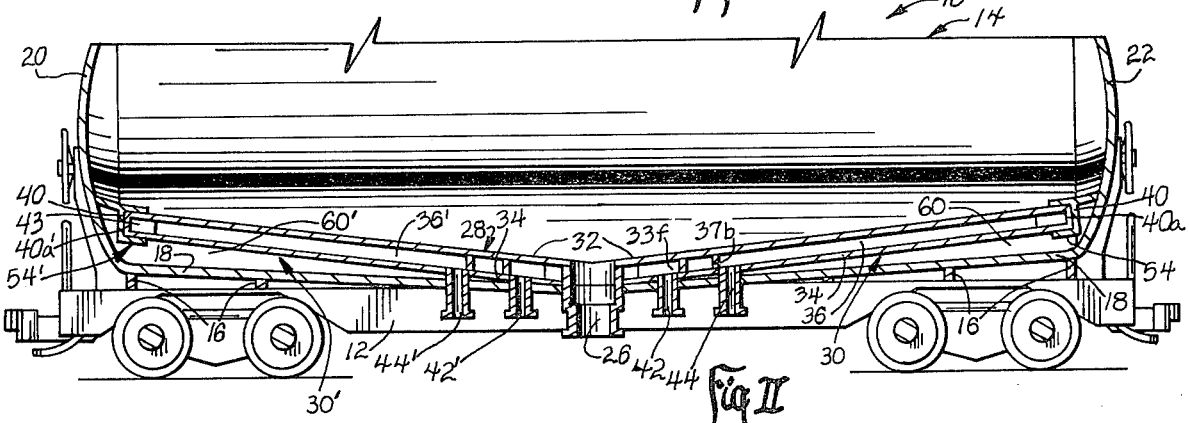
Fig II
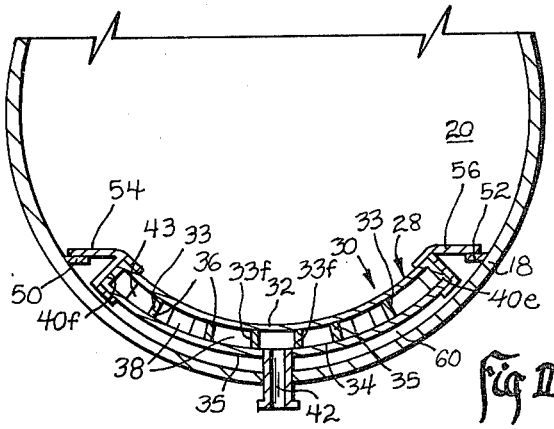
Fig III
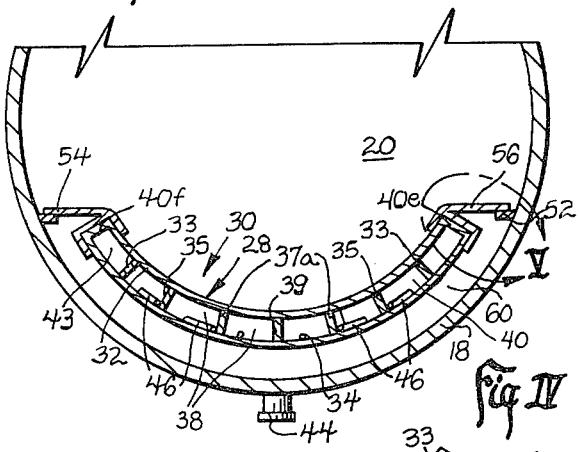
Fig IV
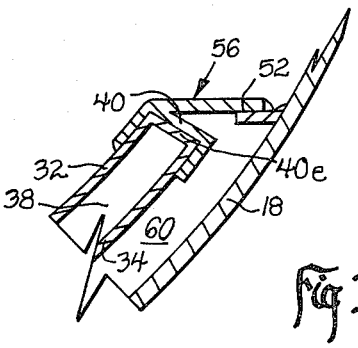
Fig V
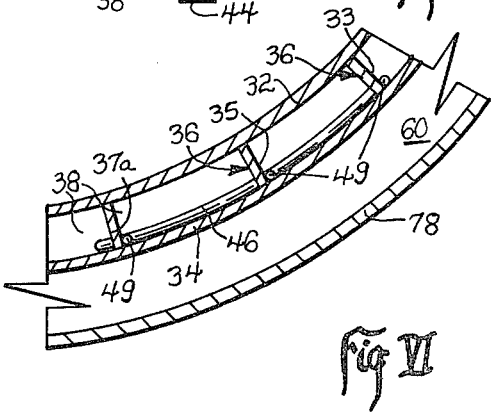
Fig VI

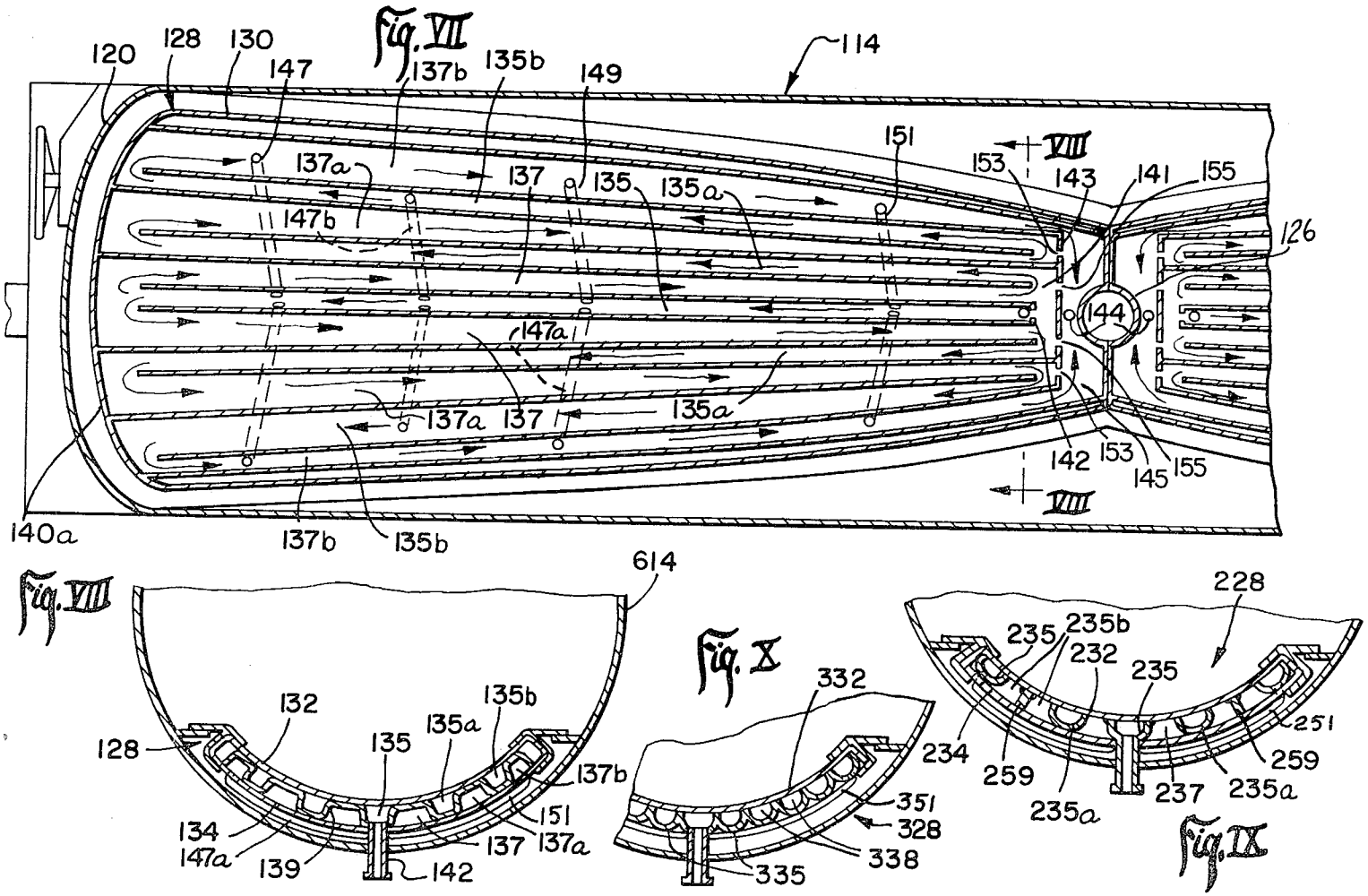
Fig. VII
Fig. VIII
Fig. IX
Fig. X
114
120
128
130
132
134
135
135a
135b
137
137a
137b
139
140a
141
142
143
144
145
147
147a
147b
149
151
153
155
126
228
232
234
235
235a
235b
237
251
259
328
332
335
338
351
614

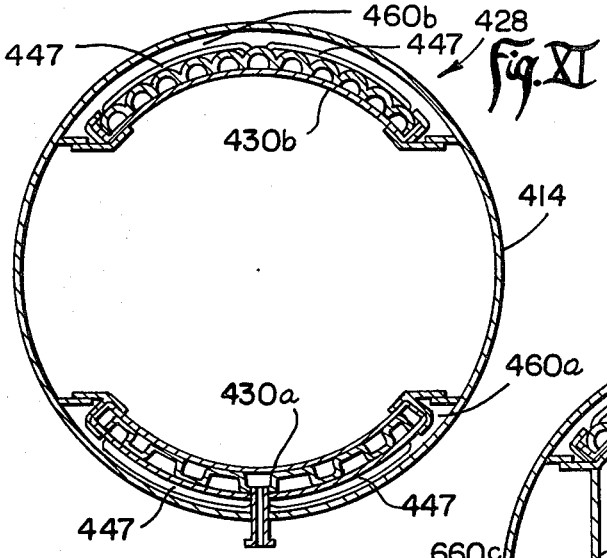
Fig. XI
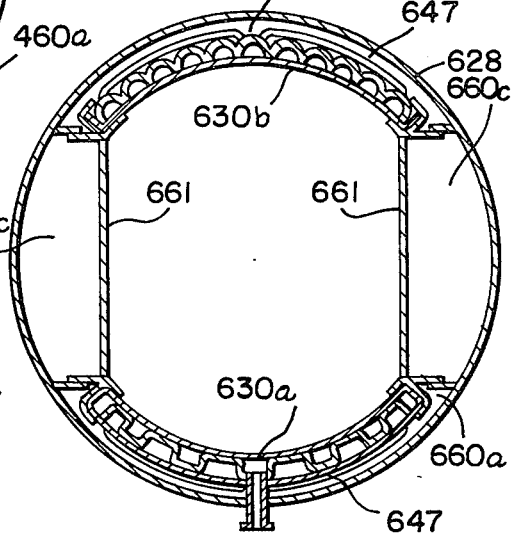
Fig. XIII
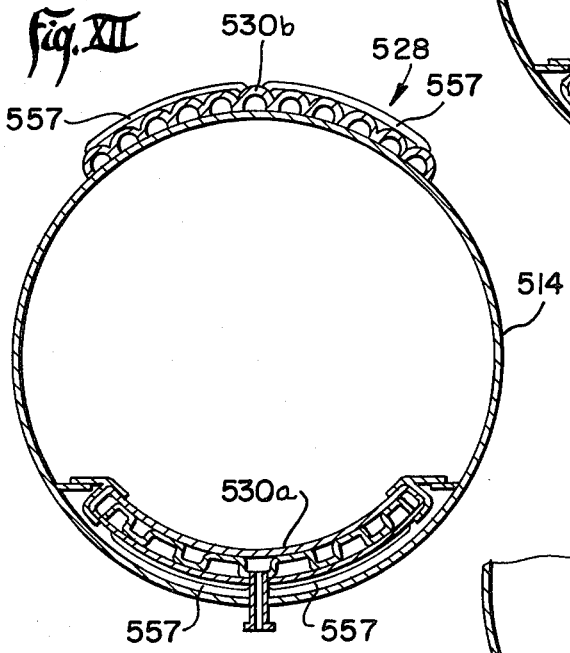
Fig. XII
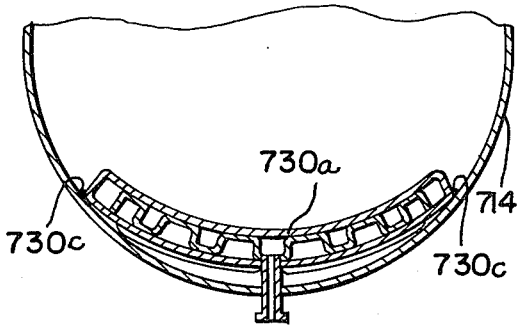
Fig. XIV

HEATED RAILROAD TANK CAR

This is a continuation-in-part application of my original U.S. patent application Ser. No. 385,869 filed on June 7, 1982.

BACKGROUND OF THE INVENTION

This invention relates to a heated railway tank car and more particularly to a heated tank car having the heat exchanger assembly provided therein.

Railway tank cars are commonly used to transport liquid commodities that must be heated to enable the material to flow and unload through the bottom or top mounted discharge valve. At the present time, the material is heated by steam which passes through coils positioned on the exterior surface of the car or by coils which are positioned in the interior of the car. Typical of the prior art devices may be found in the following patents: U.S. Pat. No. 2,145,614 discloses internal and external heating coils. U.S. Pat. No. 2,558,648 shows a heating coil secured exteriorly to a lower portion of a tank car. U.S. Pat. No. 2,772,784 describes the use of a cylindrical jacket encompassing the tank car for the purpose of applying heating from hot water flowing through the jacket. U.S. Pat. No. 3,142,108 shows a plurality of pans attached to the bottom portion of a truck trailer tank for supplying heat to the tank. U.S. Pat. No. 3,176,764 describes an integral-coil tank wall section associated with the lower portion of a tank car to transfer heat to the tank car. U.S. Pat. No. 3,228,466 shows an external heating arrangement for a storage tank. U.S. Pat. No. 3,595,307 shows another arrangement of a heating system disposed exteriorly of a tank car. Finally, U.S. Pat. No. 3,685,458 describes a heating assembly secured exteriorly to a bottom portion of a tank car.

It is apparent from the above-identified patents that there are large areas of the cars that are not subject to the heated steam and that the tank saddles and underframes attached to the bottom end of the tank act as large heat sinks which radiate heat out to the air rather than inwardly to the product. A problem also associated with the external and internal coils is that they are substantially horizontally disposed which makes them difficult to drain after the steam has been disconnected thereby causing freezing and corrosion and subsequent failure to the coils.

Still another problem associated with the prior art is that the material at the upper end of the tank is heated faster than the material at the bottom of the tank. The material at the upper portion of the tank is heated for longer than is desirable since the material will not begin to flow from the tank until the material around the discharge valve has been sufficiently heated to enable it to flow from the tank. Still another problem associated with the prior art devices is that a "boot" of material is formed in the bottom end of the car. The "boot" forms due to some commodity precipitants going to the bottom of the car due to heating and to lack of agitation. The "boot" also forms due to the heat sink effect of the steel attached to the tank at this particular location. The "boot" is the product remaining in the car after the car has been unloaded and the "boot" keeps building or accumulating thereby reducing the effective capacity of the car. At some time, the "boot" must be removed by chipping or other manual removal process.

Also, the prior art rail tank car using heated coils is not too suitable for the unloading of congealable, heat sensitive materials. Because of this, many problems have been incurred.

First, the quality of the many commodities has been affected due to over heating. On certain materials, overheating has caused the complete rejection of the commodity by the customer.

Second, heating by present methods has proven ineffective due to the problem of film buildup on the surfaces. This is caused by the settling of solids to the bottom of the car during the heating process. If not removed, the baking of the product to the surface will greatly reduce heating efficiency. The boot upon heating can also cause corrosion of the bottom of the tank.

The third, and often overlooked problem, is contamination of new high quality material by burnt commodity or heel.

Fourth is the hazard which is presented to a person who must enter this enclosed environment to remove settled or burnt material.

The concept being proposed is the use of a heat system to be installed in the bottom of a tank car with sufficient slope to permit total drainage of the commodity. Such a system would concentrate the heat in the bottom of the car to obtain maximum transfer of heat at the bottom of the commodity (lading). The heated portion of the lading, as it rises through the lading causes the unheated portions of the lading to descend to the bottom to effectively cause mixing or rolling of the lading. Such thorough and uniform heating of the lading prepares the lading for faster unloading and prevents the lading being subjected to excessive heat which burns or carmelizes the lading. Also, the application of the heat at the bottom of the lading causes faster melting of the lading in and around the outlet valve.

Heating efficiency is greater with the new system during unloading because the entire heating surface remains in contact with the lading during the unloading until the tank is almost empty. Coil cars lose heating efficiency through exposure of coils as the lading level drops in the car.

Initial tests indicate that the use of a heated exchanger in contact with the bottom of the lading improves heating efficiency. Data taken, using a series of probes located in tank cars, with readings taken every five minutes, proved that the improved heat system gave uniform heating of the contents. It was noted during the tests that a rolling action occurred during the heating process, and the lading turned, allowing mixing of the hot and cold portions.

In the tests, an external coil tank car and a plate (novel heat exchanger) tank car of equal capacity were used. Temperature probes were installed 6", 24", and 42" above the bottom of each tank car at the center. The boiler pressure was maintained at 76 to 80 PSI and the condensate was monitored for volume and termperature. In the coil tank car, the condensate flow was 3 gallons per minute with temperatures of the condensate reading 70° F. or less for the first 1 and ½ hours, and then rising to a final temperature of 90° F. In the plate tank car, the same procedure was followed as for the coil tank car, but the condensate temperature rose rapidly to 135° F. and held at a steady pace, requiring less than half of the previous time.

The temperatures in the coil tank car rose rapidly in the top portions of the lading when compared with the temperatures at the bottom portion of the lading. This heat layering was noted and monitored after 2 hours of heating, at which time, rolling or mixing action was noted. To determine this rolling action, dye was periodically added to both cars. The plate tank car showed rapid movement of the lading due to the concentration of the heat at the bottom of the car, while the coil tank car showed very slow mixing. The lading in both of the tank cars consisted of water.

Another test was run on the plate tank car only. The test was conducted using an animal fat (congealed). The heat exchanger heated the fat rapidly, then, as the rolling action started, the temperature dropped off and paralleled the temperature rise of the lading. It was noted that the valve outlet area temperature rose rapidly. This is important, for the faster the valve temperature rises, liquifying the lading in this area, the quicker the unloading can begin.

In another test, a plate tank car was filled with blackstrap molasses, which weighs 11.5 pounds per gallon. In 5 minutes, the heat system was raised to a temperature of 80° F., and the temperature around the valve outlet was at 59° F. The temperature of the molasses rose evenly throughout and there were no layers of heat in the molasses, as usually happens in present coil tank cars, wherein there is a hot layer of lading at the top and a cold layer of the lading at the bottom. The plate car was then ready to be unloaded in 15 minutes after application of the heat. After the pumping was completed, there was no molasses left in the tank car, and the lading that was removed was tested. None of this lading was burned (caramelized), which is common in high sugar products in present coil tank cars.

Thus, it can be seen that the invention accomplishes at least all of the stated objectives, which are more specifically reiterated hereinbelow:

Since units of the heat exchanger are sloped, substantially all of the condensate is drained out and the heat exchanger is not subject to any freezing.

Since the lading is substantially resting on top of the heat exchanger which applies heat over a large area of the lading, no air pockets or hot spots occur as they do in an external coil prior art tank car.

A tank car using the inventive heat exchanger, as opposed to the prior art external coil tank car, unloads much faster than the coil tank car in winter.

No cooking of the lading occurs because the heat exchanger applies uniform heat over a large area of the lading.

Approximately 4/5ths to 5/6ths of the subject tank car is empty before any portion of the heat system (heat exchange units) is exposed to the atmosphere in the tank, as opposed to the prior art internal pipe coils and external coils which are completely exposed when the tank car is $\frac{7}{8}$ths empty. Therefore, the inventive heat system continues to be in contact with the lading and heat the lading, keeping it fluid until the tank car is empty.

The pitch of each heat exchanger unit of almost 1:12 (8% grade) assures a complete unloading and prevents material buildup.

All of the heat is at the bottom of the tank car, and as the heat rises, the tank car will unload much faster, saving BTU (British Thermal Units) costs. The side coils on an external coil car do not do much good because the heat goes about 8 inches into the lading and goes through commodity to the top of the tank car. Also coils at sides of car are closer to top of car and overheat the top of the car.

By positioning the heating system off the floor of the tank car, heat sinks caused by the tank cradles, body bolsters, and trucks are non-existent or eliminated.

External coils on a coil car are positioned or spaced from one another a minimum of 6 inches between the welded positions which cause a lot of dead spots between the coils and such coils are spaced even farther apart on the bottom of the car in order to miss the stub sills and body webbing, as opposed to the inventive heat system which provides a solid (i.e. substantially continuous) heating surface at the bottom of the tank car.

In view of the flow arrangement in the heat exchanger, there is no need to steam jacket the outlet valve.

Because of the slope possessed by each unit of the heat exchanger and the rolling action of lading caused by the heating action and the slope of the heat exchanger, there is no corrosion or product buildup, as opposed to the formation of a boot in an external coil tank car, which boot cuts down on the efficiency of heat transfer on the bottom coils of the tank car and which acts as an undesirable heat insulator.

The application of heat at the bottom of the lading creates internal circulation commencing at the bottom, then upwardly through the lading, causing the cool portions of the lading to move downwardly towards the bottom, thereby creating a rolling or mixing action, resulting in a faster and uniform heating of the lading.

Since the present heating system uniformly heats the lading, the temperatures of the heating medium need not be excessive, thereby avoiding damage to plastic linings used within the tank cars, as would occur in a coil tank car.

Further, in a modified form of the invention, heat exchanger is provided with appropriate ports for the immediate purging of any condensate forming in the heat exchanger. The foregoing avoids a buildup of the condensate which opposes the introduction of the pressurized heating medium. Also such condensate buildup saps the incoming heat so that it is revaporized. In cold weather, the buildup of condensate forms a liquid plug which has to be bodily moved forward by the incoming heating medium, thereby requiring an increase in the pressure of the incoming heating medium.

Therefore, it is a principal object of the invention to provide an improved heated tank car.

A further object of the invention is to provide a heated tank car having a heat exchanger provided in the interior thereof with the heat exchanger being insulatingly spaced above the bottom of the tank to achieve a more efficient and uniform heating of the material.

A still further object of the invention is to provide a heated tank car which eliminates the heat sink problems normally associated with conventional heated tank cars.

Still another object of the invention is to provide a heat exchanger for a tank car which is sloped towards the middle of the car so that condensate will drain from the heat exchanger thereby reducing corrosion of the heat exchanger.

Still another object of the invention is to provide a heated tank car which prevents the formation of a "boot" at the bottom of the car.

A further object of the invention is to provide drainage means in the heat exchanger for purging any heating medium condensate that may form within the heat exchanger.

Still another object of the invention is to provide a heated tank car employing an inclined heat exchanger therein to assist the flow of material to the discharge valve of the car.

These and other objects will be apparent to those skilled in the art.

BRIEF DESCRIPTION OF THE DRAWINGS

FIG. 1 is a plan longitudinal sectional view of the tank car and heat exchanger therein:

FIG. 2 is a partial side longitudinal sectional view of the car and heat exchanger:

FIG. 3 is an enlarged sectional view taken on lines 3—3 of FIG. 1:

FIG. 4 is an enlarged sectional view taken on lines 4—4 of FIG. 1:

FIG. 5 is an enlarged sectional view taken on lines 5—5 of FIG. 4:

FIG. 6 is an enlarged sectional view taken on lines 6—6 of FIG. 1;

FIG. 7 is a plan longitudinal partial sectional view of a tank car equipped with a modified heat exchanger therein:

FIG. 8 is an enlarged sectional view taken on lines 8—8 of FIG. 7;

FIG. 9 is an enlarged sectional view of a further embodiment of the heat exchanger: and FIG. 10 is an enlarged partial sectional view of a still further embodiment of the heat exchanger;

FIG. 11 is another embodiment of the heat exchanger utilizing two heating units, one above and one below;

FIG. 12 is an embodiment similar to that shown in FIG. 11 except that the upper heating unit is disposed exteriorly of the tank;

FIG. 13 is an embodiment using a pair of heating units for heating a tank car provided with additional dead air spaces; and FIG. 14 is a further embodiment of a heat exchanger wherein a heating unit is secured directly to the inside of the tank car, without using brackets.

SUMMARY OF THE INVENTION

A heated tank car is disclosed which has a heat exchanger means positioned therein above the bottom of the tank. The heat exchanger comprises a pair of heat exchanger units which are secured to and supported by the ends and side walls of the tank and which extend downwardly from the ends of the tank towards the center of the tank. Each of the heat exchanger units comprises spaced-apart top and bottom walls or plates which have a plurality of spaced-apart baffle plates secured thereto and extending therebetween to define a plurality of baffles or passageways within the heat exchanger. An inlet valve or pipe is in communication with the inner end of each of the heat exchanger units with the baffle plates being arranged so that heated water or steam is directed back and forth through the heat exchanger for subsequent discharge through the heat exchanger for subsequent discharge through a discharge pipe or valve extending downwardly from the heat exchanger unit through the tank car. The peripheries of the heat exchanger units are supported by and secured to the side walls and end of the tank so that a sealed compartment or dead air space is created below the heat exchanger thereby reducing the heat sink effect of the tank saddles and under frames attached to the tank. To further accelerate the heating of the lading, additional heating units may be disposed adjacent the top of the tank so that the lading is sandwiched between opposed heating units. The heat exchanger means may be provided with drainage parts communicating between the passageways and the discharge pipe for purging heating medium condensate that may form during the heating of the tank car.

DESCRIPTION OF THE PREFERRED EMBODIMENT

The numeral 10 refers to a conventional railway tank car comprising a wheeled support 12 of conventional design. Storage container or tank 14 is mounted on the frame 12 by conventional structure such as by tank saddles 16. Tank 14 generally has a cylindrical configuration although the bottom 18 of the tank 14 slopes inwardly from the ends of tank heads 20 and 22 towards a discharge valve assembly 26. It is to this conventional tank car structure that the heat exchanger of this invention is mounted and which will be referred to generally by the reference numeral 28.

Heat exchanger 28 comprises heat exchanger units 30 and 30' which are identical except for being mirror images of each other. Inasmuch as units 30 and 30' are identical, only unit 30 will be described in detai with "'" being indicated on unit 30' to indicate identical structure.

Heat exchanger unit 30 comprises arcuate top and bottom plates 32 and 34 having a plurality of baffle plates 36 secured thereto and extending therebetween as best illustrated in FIG. 1 to create a plurality of passageways 38 therebetween. The peripheries of plates 32 and 34 (FIG. 3) are secured together and sealed by a wall member 40 extending therearound and define therewith a heat exchanger medium containing chamber 43. As seen in FIG. 1, the inner end of wall 40 is curved at 41 so as to conform to the configuration of the upper end of the discharge valve 26. The numeral 42 refers to an inlet extending upwardly through the bottom of the tank 14 and in communication with the interior of the heat exchanger as best seen in FIGS. 2 and 3. Outlet 44 also extends upwardly through the bottom of the tank 14 and is in communication with the interior of the heat exchanger as illustrated in FIG. 2.

More specifically, the heat exchanger unit 30 is defined as follows.

The heat exchanger outer wall 40 has a curved outer end portion 40*a*, 40*a'*, a flat inner end portion 40*b*, 40*b'* with a curved tank outlet surrounding portion 40*c*, 40*c'* (FIG. 1) and longitudinally extending flat side portions 40*e* and 40*f* that diverge inwardly toward one another.

The baffle plates 36 include U-shaped outer baffle plate member 33 surrounded by wall 40 and having outer longitudinally extending legs 33*a*, 33*db* that diverge outwardly from one another, the outer ends 33*c* of legs 33*a*, 33*b* being spaced away from curved end portion 40*a;* and laterally extending inner end portion 33*d* that has a central curved portion 33*e* going around part of the tank drain 26 and having U-shaped outwardly directed bight portion 33*f* surrounding the inlet 42.

The baffle means further includes longitudinally elongated fins or plates 35, 35 adjacent wall portion 40*b* and connecting with the curved portion 40*a* and extending short off the inner end portion 33*d;* a hairpin shaped longitudinally entending central baffle plate 37 having outwardly diverging leg portions 37*a*, 37*a* ending short of the outer curved portion 40*a* and inner curved end portion 37*b* curved around part of heat exchanger outlet 44; and a shortened central plate 39 that extends in slightly between leg portions 37*a*, 37*a*.

The heat exchanger 32 has the same baffle construction and need not be described further.

The numerals 46 and 48 (FIG. 1) refer to tubing provided at the upper surface of the bottom plate 34 to assist in draining the condensate in the heat exchanger unit toward the outlet or discharge 44. The baffles 36 are provided with openings 49 at the tubes 46 and 48 to enable the condensate in the passageways to flow through the baffle plates so that the condensate is discharged closely adjacent the outlet 44.

Bars 50 and 52 are welded to the interior surface of the sides of the tank as seen in FIG. 3. Bars or brackets 54 and 56 are secured to the sides of the heat exchanger unit 30 and are welded to the bars 50 and 52 respectively. Bar or bracket 54 or 56 is also secured to the outer ends of the heat exchanger unit 30 and is welded to the bar 50 or 52 on the interior surface of the tank head end 20 or 22.

The conventional tank car 10 may be converted to the heated tank car of this invention by first removing a portion of all of the ends or heads 20 and 22. Preferably, the bars 50 and 52 would then be welded to the interior surfaces of the side walls of the tank. The heat exchanger units 30 and 30' are then inserted into the interior of the tank so that the brackets 54 and 56 rest upon the bars 50 and 52 respectively and so that the inner end of the units are positioned adjacent the discharge valve 26. The tank bottom 18 would have been previously cut away to provide the inlets and outlets of the heat exchanger to extend downwardly through the bottom 18 of the car. The heads 20 and 22 are then replaced in conventional fashion with brackets 54 and 56 then being welded in a continuous fashion to the interior surfaces of tank heads. The new brackets 54 and 56 are also welded to the bars 50 and 52. Preferably, the inner ends of the heat exchanger units would also be welded together so that a sealed compartment or dead air space 60 is created below the heat exchanger and the bottom 18.

In use, assuming that the car contained a liquid commodity, steam or hot water would be connected to the inlets 42 and 42'. The incoming steam passes around the discharge valve 26 and then travels in the paths defined by the arrows in FIG. 1 for subsequent discharge through the outlets 44 and 44'. Heating of the material (lading) by the heat exchanger would initially cause the material in contact with the heat exchanger to flow towards the discharge valve 26 assisted by the weight of the material on top. This method of heating the lading eliminates part of the material being overheated awaiting for the material to start flowing downwardly through the discharge valve. The provision of the space 60 between the heat exchanger and the bottom of the tank prevents the undercarriage and saddles of the car from acting as heat sinks so that a much more efficient heating of the lading is obtained. The fact that the heat exchanger slopes towards the discharge valve assists the flow of material to the discharge valve 26.

Thus it can be seen that a novel heated tank car has been provided which provides a more efficient heating of the lading and which eliminates the formation of a "boot" of material at the bottom of the car. It can also be seen that the sloping of the heat exchanger unit and the elements 46 and 48 aid in the prevention of condensate accumulating in the heat exchanger thereby eliminating the serious problem of corrosion normally asciated with prior art devices.

A further feature of the invention lies in the elimination of the heating medium condensate which forms inside the heat exchanger during the process of heating the lading in the tank car. The foregoing feature is illustrated with the following embodiment of the heat exchanger illustrated in FIGS. 7 and 8.

Within a tank 114, there is mounted a heat exchanger 128 comprising a pair of heat exchange units 130, 130. Since both units are identical in construction, only the left portion of the tank 114 is shown supporting one of the heat exchange units 130, 130. Since the heat exchanger 128 is supported in the same manner as the heat exchanger unit 28 described in reference to FIGS. 1–6, there is no necessity for describing the support structure.

The heat exchanger unit 130 comprises arcuate top and bottom plates 132 and 134 supporting therebetween a plurality of channels 135 and 137 as defined by baffles in the form of a corrugated member 139 interposed between the top and bottom arcuate plates 132 and 134. It will be noted, as viewed in FIG. 8, that the channels do not possess equal cross-sectional areas. For example, the channel 135 is smaller than the channel 137, the smaller channels 135 functioning to direct a heating medium (steam) upwardly from an inlet 142 toward a tank head 120 and the larger channel 137 directing the heating medium (steam) downwardly toward outlet 144.

Referring particularly to FIG. 7, the heating medium such as steam entering the heat exchanger means 128 through the inlet 142 progresses upwardly through the narrow channel 135 until it reaches heater exchanger curved end portion 140*a*, at which time, the steam subdivides into two portions which flow along a pair of wide channels 137, 137 until the steam portions reach a minor manifold 141 which directs the steam into narrow channels 135*a*, 135*a*. The steam upon reaching the curved end portion 140*a*, is redirected thereby into wide channels 137*a*, 137*a*, the steam continuing on its way until it meets an inner wall 143 which redirects the steam into narrow channels 135*b*. Thereafter, the steam, after it leaves the channels 135*b*, impinges on the curved end portion 140*a* which redirects the steam along the wide channels 137*b*, the steam finally completing its passage in a main manifold 145 communicating with the atmosphere through an outlet 144. In the alternative, the exciting steam may reenter a reheating chamber in the steam apparatus (not shown) generating the steam.

As was previously described in reference to the first embodiment shown in FIGS. 1–6, application of heat at the bottom of the lading will develop a rolling or a circulating flow in the lading as heat continues to be imparted to the lading. That is, the heated portion of the lading, as it rises through the lading causes the unheated portions of the lading to descend to the bottom to effectively cause mixing or rolling of the lading. Such thorough and uniform heating of the lading prepares the lading for faster unloading and prevents the lading being subjected to excessive heat which burns or carmellizes the lading. Similar circulation of lading occurs in the embodiment shown in FIGS. 7 and 8.

To increase the heating and the flow movements of the lading, the heat exchanger 128 is provided with feeder lines 147, 149, and 151. The flaring out of the passages lines as they proceed out to ends of the tank, also enhances flow movements of the steam and condensate and increases faster heating of the lading. These feeder lines communicate between the narrow channel 135 and the wide channels 137*b*, thereby permitting a portion of the steam entering the channel 135 to be directed outwardly into the outermost channels 137*b* to provide steam quickly for quick heating of the extremities of the heat exchanger with steam to assist in purging the heat exchanger with steam and more quickly warm up the lading. To further increase the heating and the flow movements of the lading, the heat exchanger 128 may be provided with additional feeder lines 147*a* and 147*b*, as shown particularly in FIG. 7.

The additional feeder lines 14*a* and 147*b* interconnect between the channel 135 and the channels 135*a* to thereby direct a portion of the steam flowing in the channel 135 to the channels 135*a*.

Referring still to FIG. 7, any condensate that forms in channels 137*a* and 135*b* will flow downwardly toward the inner wall 143 and pass through an internal drainage port 153 into the minor manifold 141 to join with additional condensate which is formed in channels 137 and 135*a*, which additional condensate also flows towards the inner wall 143, and then finally exits through an external drainage port 155 which communicates with the outlet 144. As is apparent, the drainage provides removal of the condensate during application of the steam and adequate gravity drainage of the exchanger after the tank car has been emptied. Any condensate formed in central channel 135 flows downward below the steam moving upstream and out drainage port 142 and through port 155 to outlet 144.

The corrugated member 139, as shown in FIG. 8, is secured to the top arcuate plate 132 and the bottom arcuate plate 134 by appropriate manner, such as welding. This ensures that there is no transverse heating medium flow between adjoining channels 135 and 137.

The feeder lines 147, 149, 151, 147*a* and 147*b*, may be arranged to pass through the walls forming the various channels. However, in the preferred arrangement, the various feeder lines do not pass through the walls of the channels, but are disposed exteriorly of the channels. Referring to FIG. 8, the feeder lines, for example, feeder lines 147*a*, are secured exteriorly of the heat exchanger 128 by being secured underneath the bottom arcuate plate 134. The particular feeder lines 147*a* extend between and communicate with the channels 135 and 135*b*.

From the arrangement shown in FIGS. 7 & 8 it is seen that the steam coming into the inlet and going up the central passage and then along the side passages the heat exchanger permits any condensate water that is formed to roll down well below the steam and by this technique the steam can quickly get to the steam exiting at the bottom of the tank without having to push any water or condensate out through the passageways and therefore permit a fast purging of the heat exchanging system.

Although the embodiment disclosed in FIG. 8 uses a corrugated member 139 to define a plurality of different size channels, it is apparent that other arrangements may be employed for creating the channels. For example, as shown in FIG. 9, a heat exchanger 228 comprises baffles having a plurality of spaced narrow channels 235 which are defined by a series of longitudinal half-oval members 235*a* secured to a top arcuate plate 232 and a bottom arcuate plate 234 and a plurality of wide channels 237 defined by the spaces between adjoining half-oval members 235*a*. Since the half-oval members 235*a* do not provide sufficient rigidity to the heat exchanger 228, a pair of longitudinal bars 259 are secured between the top and bottom arcuate plates 232 and 234, respectively. The longitudinal bars 259, in conjunction with adjacent half-oval members 235*a*, define a pair of channels 235*b* adjacent each of said longitudinal bars 159. The arrangement of the spacing of the narrow channels 235 conducting the steam in an upward directions, and the wide channels 237 directing the steam on its return path in a downwardly direction is the same as was described in reference to the embodiment shown in FIGS. 7 and 8. For example, as shown in FIG. 9, the narrow channels 235 formed by the half-oval members 235*a*, are separated by the wide channels 237 established between the top arcuate plate 232 and the bottom arcuate plate 234 and the adjoining half-oval members 235*a*, or by the wide channels 235*b* established between the top arcuate plate 232 and the bottom arcuate plate 234 and the longitudinal bars 259. From the foregoing example, it is obvious that other arrangements may be employed for defining the channels between the top and bottom arcuate plates 232 and 234, respectively. A number of feeder lines, such as feeder line 251, interconnect the innermost channel with the outermost channels to direct a portion of the steam to the outer boundaries of the heat exchanger 228. The remaining structural details of the embodiment shown in FIG. 9 are the same as those in connection with the embodiment described in FIGS. 7 and 8. In other words, the arrangement of the inlet, outlet and drainage ports would be the same.

FIG. 10 shows a modified structure of a heat exchanger means 328 having a plurality of channels or passageways 338 defined by longitudinal arcuate members 335 adjoining each other and secured to an arcuate plate 332. A number of feeder lines, such as feeder line 351, interconnect the innermost channel with the outermost channels to direct a portion of the steam to the outer boundaries of the heat exchanger 328.

FIG. 11 shows another modified structure of a heat exchanger 428 comprises a pair of heat exchanger units 430*a* and 430*b*, oppositely disposed with respect to each other to apply heat to the lading between said heat exchanger units. As described in reference to the preceding embodiments, the heat exchanger units are insulated from the wall of the tank 414 by dead air spaces 460*a* and 460*b*. Some of the channels are interconnected by feeder lines 447, as previously described in reference to the embodiment shown in FIG. 7.

FIG. 12 shows a still further modification of a heat exchanger means 528 having a pair of heat exchanger units 530*a* and 530*b* adapted to impart heat to a lading inside the tank 514. The heat exchanger unit 530*a* is similar to the heat exchanger units previously described. The heat exchanger unit 530*b* comprises a series of tubes arranged in serpentine fashion on top of the tank 514. The arrangement of the two heat exchanger units 530*a* and 530*b* imparts heat to the lading disposed between these heat exchanger units. Some of the channels in the heat exchanger units 530*a*, 530*b* are interconnected by feeder lines 557. The heat exchanger unit 530*b* can be permanently mounted on top of the tank 514 for heating lading, such as sulfur, requiring a large input of heat for liquefacation purposes. Alternatively, the heat exchanger unit 530*b* may be a portable unit which can be placed atop the tank 514, as the occasion demands.

The embodiment illustrated in FIG. 13 is secured within a tank 628 which has been provided with additional dead air spaces 660*c* as defined by upstanding walls 661. These additional dead air spaces 660*c* cooperate with dead air spaces 660*a*, 660*b* to increase heat transfer from heating units 630*a*, 630*b* to the lading in the tank 614. As in the preceding embodiments, feeder lines such as feeder lines 647 interconnect some of the channels in the heating units.

FIG. 14 shows another way of securing a heat exchanger unit 730*a* to a tank 714. Instead of using intermediate members for securing the heat exchanger unit to the tank, the intermediate members comprising brackets 54, 56 and bars 50, 52, as shown in FIG. 3, these intermediate members can be eliminated by securing the heat exchanger units 730*a* directly to the tank 714 by appropriate manner such as a continuous welding bead 730*c* which secures the outer periphery of the heating unit to the tank 714.

This invention, as described, should not be restricted to the precise details of construction shown, since various changes and modifications may be made therein without departing from the scope of the invention or sacrificing the advantages to be derived from its use.

What is claimed is:

1. For use in a fluid lading carrying tank having a discharge duct, a heat exchanger for heating a congeliable lading in said tank, said heat exchanger comprising a structure adapted to abut said discharge duct and having a plurality of longitudinally extending flow passages adapted to receive and conduct a heated medium, said structure extending substantially across the entire lower portion of said tank and being configured and inclined along longitudinal and transverse axes and defining a low area to develop gravity drainage, said heat exchanger having an inlet and an outlet substantially encompassing in heat exchange relationship and disposed adjacent said discharge duct within the tank.

2. A heated tank system comprising:

a horizontally diposed lading container having opposite ends, and top and bottom portions, said lading container having at least an inlet and a discharge valve assembly, said discharge valve assembly being disposed in said bottom portion, a heat exchanger means mounted within said container spaced above the bottom portion of said container and having an interior compartment for receiving a heated medium therein for heating the lading in said container above said heat exchanger means, said heat exchanger means having at least one inlet and at least one outlet in fluid communication therewith, said heat exchanger means being inclined downwardly along the entire longitudinal and transverse axes of said container, toward said discharge valve assembly, said inlet and outlet being disposed near said discharge valve assembly, the spacing between said heat exchanger means and said bottom portion constituting a dead air space for insulating said heat exchanger means from said bottom portion, said heat exchanger means having a structure in heat transfer relationship with said discharge valve assembly, said inlet in said heat exchanger substantially encompassing in heat exchange relationship and being disposed adjacent said discharge valve assembly within the container, whereby the entry of the heated medium through said inlet envelopes a substantial portion of said discharge valve to immediately initiate the heating of the portion of the lading adjacent said discharge valve.

3. A heated tank system comprising:

a horizontally disposed lading container having opposite ends, and top and bottom portions, said lading container having at least an inlet and a discharge valve assembly, said discharge valve assembly being disposed in said bottom portion, a heat exchanger means mounted within said container spaced above the bottom portion of said container and having an interior compartment for receiving a heated medium therein for heating the lading in said container above said heat exchanger means, said heat exchanger means having at least a pair of inlet-outlet openings in fluid communication therewith, said heat exchanger means extending downwardly substantially along the entire longitudinal axis extending from one of said ends to said discharge valve assembly and said heat exchanger means sloping substantially across the transverse axis of said container, one of said inlet-outlet openings of said heat exchanger means being disposed substantially adjacent to and encompassing in heat exchange relationship said discharge valve assembly within the container, the spacing between said heat exchanger means and said bottom portion constituting a dead air space for insulating said heat exchanger means from said bottom portion, said heat exchanger means having means in heat transfer relationship with said discharge valve assembly.

4. The heated tank system of claim 3 wherein said heat exchanger means has a transverse downwardly bowed concave configuration.

5. The heated tank system of claim 3 wherein said system includes a wheeled support means for transporting the container.

6. The heated tank system of claim 3, wherein the heated medium leaving said heat exchanger means passes closely adjacent the discharge valve assembly prior to exiting from said unit outlet.

7. The heated tank system of claim 3 wherein the compartment of said heat exchanger means comprises spaced-apart top and bottom plates defining a chamber for receiving and circulating said heated medium.

8. The heated tank system of claim 7 wherein a plurality of spaced-apart baffle plates are secured with said top and bottom plates and extend therebetween to define fluid passageways therebetween, said baffle plates extending substantially over the entire bottom portion of said container.

9. The heated tank system of claim 8 wherein sad heat exchanger means includes first and second heat exchanger units in end-to-end relationship and said baffle plates in each of said heat exchanger units are arranged so that the heated medium entering the unit through its said inlet initially moves longitudinally towards the outer end of said unit thence laterally towards both sides of said container, thence longitudinally towards the inner end of the unit; thence laterally; thence longitudinally back towards the outer end of the unit; thence laterally; thence longitudinally back towards the inner end of the unit; thence outwardly through said outlet.

10. The heated tank system of claim 8, wherein said baffle plates in said heat exchanger means are arranged so that the heated medium entering the heat exchanger means through its inlet, disposed near an inner end of said heat exchanger means, initially moves longitudinally towards an outer end of said heat exchanger means; thence laterally towards both sides of said container; thence longitudinally towards the inner end of the heat exchanger means; thence laterally; thence longitudinally back towards the outer end of the heat exchanger means; thence laterally; thence longitudinally back towards the inner end of the heat exchanger means; thence outwardly through said outlet.

11. The heated tank system of claim 3 wherein said heat exchanger means has a longitudinal section V-shaped configuration.

12. The heated tank system of claim 11, wherein the plurality of spaced-apart baffle plates are interconnected by drainage tubing slanting toward the outlet of said heat exchanger means, said drainage tubing communicated with two or more passages between said baffle plates; whereby said drainage tubing facilitates the draining of condensate from said passages.

13. The heated tank system of claim 3 wherein said container has opposite side walls extending between its ends, and wherein said heat exchanger means is supported on and secured to said side walls and said ends of said container whereby the fluid lading carried by said container is supported by said heat exchanger means.

14. The heated tank system of claim 13 wherein said heat exchanger means includes support means attached to the lower portion of the container for supporting said heat exchanger means above the bottom of the container to define a dead air space between said heat exchanger means and said bottom of said container; whereby said dead air space acts as a heat inslulating means to prevent transmission of heat from the heat exchanger means to an undercarriage of said container.

15. A heated tank system of claim 3, wherein said heat exchanger means has a structure configured substantially across the entire bottom portion of said lading container in supportive relationship to said lading.

16. A heated tank system of claim 15, wherein said heat exchanger means has a portion substantially encompassing said discharge valve assembly for directing said heated medium to said discharge valve assembly.

17. A heated tank system according to claim 3, wherein the compartment of said heat exchanger means comprises spacedapart top and bottom plates peripherally sealed and having a plurality of passages in said compartment.

18. A heated tank system according to claim 17, including a corrugated member disposed in said compartment and defining said passages.

19. A heated tank system according to claim 17, including a plurality of arcuate members adjoining said others and secured together by an arcuate plate to define said passages.

20. A heated tank system according to claim 17, including a plurality of spaced narrow half-rounded members secured between said top and bottom plates, the spaced members defining therebetween wide channels.

21. The heated tank system of claim 3 wherein said heat exchanger means comprises first and second heat exchanger units positioned in said container in an end-to-end relationship.

22. The heated tank system of claim 21 wherein the discharge valve assembly is totally encompassed by the adjacent ends of said first and second heat exchanger units.

23. The heated tank system of claim 21 wherein the inlet and outlet of each of said heat exchanger units are positioned adjacent said discharge valve assembly.

24. The heated tank system of claim 21 wherein the heated medium leaving each of said units passes closely adjacent said discharge valve assembly prior to exiting from said unit outlet.

25. The heated tank system of claim 21 wherein the inner end of each of said heat exchanger units is positioned lower than the outer end of the heat exchanger unit and wherein the discharge valve assembly is positioned at the inner ends of said units.

26. In the heating of a fluid in a lading storage container tank having a discharge valve and upper outer and lower inner gravity flow portions intermediate its ends, a heat exchanger means being positionable in the lower area of the tank longitudinally thereof between the upper and lower portions and sloping downwardly from the upper portion to the lower portion towards said discharge valve;

said heat exchanger means being spaced from the bottom of said tank and defining a dead air space between said tank bottom and said heat exchanger means;

said heat exchanger means being provided with inlet and outlet port means in the lower portion substantially encompassing in heat exchange relationship and adjoining said discharge valve within the container, the outlet port means being outwardly of the inlet port means;

said heat exchanger means being further provided with baffle means extending longitudinally and transversely over a substantial area of a bottom portion of the tank and presenting a continuous back and forth longitudinally and latitudinally serpentine passage means and directing an associated heat exchanger medium from the inlet port means at one end of the passage means to the outlet port means at the other end of the passage means, said tank having a discharge orifice in the lower portion thereof inwardly of the inner and outer heat exchanger port means, said heat exchange means having a portion in heat exchange relationship with said discharge orifice.

27. The heat exchanger means according to claim 26 wherein said heat exchanger means includes a pair of adjacent heat exchanger units, one on each side of the discharge orifice and the passage means including a serpentine passageway in each unit; said upper tank portion including upper ports at each opposite end of the tank portion and each unit being longitudinally spaced from the other and each unit having a lower end extending in the lower tank portion and an outer end extending into a respective upper tank part, each heat exchanger unit sloping downwardly toward the other to define in elevation a generally V-shaped heat exchanger means whereby the associated heat exchange medium in each heat exchanger unit courses back and forth longitudinally in its respective serpentine passageway to provide for initial heat exchange in the lower areas of the tank, the inner and outer port means defining an inner and outer port in a respective heat exchanger unit, the ports of each heat exchanger unit being on opposite ends of the discharge inlet for providing initial heat transfer in the area of the discharge orifice.

28. The heat exchanger means according to claim 26 wherein said tank is provided with heat exchanger mounting means adapted to releasably receive said heat exchanger means and extending about the periphery of said heat exchanger means and is provided with the heat exchanger means a sealed thermal insulating space between the heat exchanger means and the bottom of the tank.

29. The heat exchanger means according to claim 26 wherein said heat exchanger means comprises an outer annular wall defining a heat exchanger medium chamber therein, and said baffle means is disposed within said chamber and includes an outer generally U-shaped baffle member having a lower transverse end portion adjacent the discharge orifice and being adjacent the heat exchanger inlet and separating it from the heat exchanger outlet, and said U-shaped member having a pair of longitudinally extended legs forming passage with the outer end of the outer wall for conducting heat exchange medium from the heat exchanger inlet outwardly toward the outer end of the heat exchanger, said wall having an outer transverse wall portion, a pair of longitudinally extended baffle plates connecting with the wall portion, and adjacent each respective leg to define additional passage for returning the medium toward the heat exchanger inlet, a central U-shaped member between the baffle plates having leg portions extending toward the outer end of the heat exchanger, and a central shortened baffle plate attached to the outer transverse wall portion of the heat exchanger and extending inwardly of the legs of the central U-shaped member to define therewith and with the central plate passage for the heat exchanger medium away from and then toward the inner end of the heat exchanger, said central U-shaped member having a closed end partially surrounding the heat exchanger outlet for receiving the extending heat exchanger medium.

30. The heated tank system of claim 26, wherein said heat exchanger means positioning means comprises a continuous weld bead securing the periphery of said heat exchanger means to said container.

31. A heated tank system according to claim 26, including an additional heat exchanger means, and further means for positioning said additional heat exchanger means inside said lading container in the upper portion thereof, and defining a dead air space between the top of said container and said additional heat exchanger means, further including means extending between both of said heat exchanger means and defining and completing the dead air space, whereby the lading is completely insulated from longitudinal walls of the lading container.

32. The heat exchanger means according to claim 26 wherein said baffle means includes a plurality of baffle members extending generally longitudinally of the tank and spaced laterally from one another to define the serpentine passage means.

33. The heat exchanger means according to claim 32 wherein transversely extending drain means intersect the baffle members above the outlet port means attendant to draining associated heat exchanger medium in the passageway toward the outlet port.

34. A heated tank system according to claim 33, including an additional heat exchanger means, and further means for positioning said additional heat exchanger means inside said lading container in the upper portion thereof, and defining a dead air space between the top of said container and said additional heat exchanger means.

35. The heated tank system according to claim 33, including an additional heat exchanger means, and means for positioning said additional heat exchanger means on top of said lading container.

36. A heated tank system comprising:

(a) A horizontally disposed lading container having opposite ends, and top and bottom portions, (b) said lading container having a least an inlet and an outlet, (c) a heat exchanger means mounted within said container and spaced above the bottom portion of said container and having an interior compartment for receiving a heated medium therein for heating the lading substantially supported by said heat exchanger means, the spacing between said heat exchanger means and said container bottom portion defining a dead air space for insulating said heat exchange means from said bottom portion, (d) said heat exchanger means having at least one inlet and at least one outlet in fluid communication with each other, said inlet and said outlet substantially encompassing in heat exchange relationship and being disposed near said container outlet within said container, said heat exchanger means being configured substantially across the entire bottom portion of said container, said heat exchanger means having a portion thereof abutting said container outlet, and (e) means for sealingly positioning said heat exchanger means in said lading container for sloping downwardly said heater exchanger means toward said outlet in said lading container.

37. The heated tank system of claim 36, wherein said heat exchanger means has a longitudinal sectional V-shaped configuration.

38. The heated tank system of claim 36, wherein said heat exchanger means has a transverse sectional arcuate configuration.

39. The heated tank system of claim 36, wherein said container has opposite side walls extending between its ends, and support means for securing said heat exchanger means to said side walls and said ends of said container whereby the fluid lading carried by said container is maintained above said heat exchanger means.

40. The heated tank system of claim 36, wherein said heat exchanger means includes first and second heat exchanger units in end-to-end relationship, baffle plates in each of said heat exchanger units are arranged so that the heated medium entering the unit through its said inlet initially moves longitudinally, along the lowermost portion of the unit, towards the outer end of said unit, thence laterally towards both sides of said container, thence longitudinally towards the inner end of the unit; thence laterally; thence longitudinally back towards the outer end of the unit; thence laterally; thence longitudinally back towards the inner end of the unit; thence outwardly through said outlet.

41. The heated tank system of claim 36, wherein said system includes a wheeled support means for transporting the container.

42. The heated tank system of claim 36 wherein the compartment of said heat exchanger means comprises space-apart top and bottom plates defining a chamber for receiving and circulating said heated medium.

43. The heated tank system of claim 42, wherein a plurality of spaced-apart baffle plates are secured with said top and bottom plates and extend therebetween to define fluid passageways therebetween.

44. The heated tank system of claim 43, wherein said baffle plates in said heat exchanger means are arranged so that the heated medium entering the heat exchanger means through its said inlet initially moves laterally towards both sides of said container; thence longitudinally towards the outer end of the heat exchanger means; thence laterally toward the center of said heat exchanger means; thence longitudinally back towards the inner end of the heat exchanger means; thence laterally; thence longitudinally back towards the outer end of the heat exchanger means; thence longitudinally towards the inner end of the heat exchanger; thence outwardly through said outlet.

45. The heated tank system of claim 36, wherein said inlet and said outlet in said heat exchanger means adjoins the outlet in said lading container.

46. The heated tank system of claim 45, wherein said support means comprises a bar element secured to the lower portion of said container, and said heat exhanger means includes a peripheral bracket means adapted to sit upon said bar element, whereby the securement of said bracket means to said bar element, such as by welding, defines a dead air space between said heat exchanger means and said bottom of said container.

47. A heated tank system of claim 45, wherein inlet of the heat exchanger is disposed between the outlet of the heat exchanger and the outlet in said lading container.

48. A heated tank system of claim 45, wherein the outlet of the heat exchanger is disposed between the inlet of the heat exchanger and the outlet in the lading container.

49. The heated tank system of claim 36, wherein said heat exchanger means comprises first and second heat exchanger units sealingly positioned in said container in an end-to-end relationship.

50. The heated tank system of claim 49, wherein the outlet of said container is encompassed by the adjacent ends of said first and second heat exchanger units.

51. The heated tank system of claim 49, wherein the inlet and outlet of each of said heat exchanger units are positioned at the inner end of the respective unit outwardly of the container outlet.

52. The heated tank system of claim 49, wherein the heated medium leaving each of said units passes closely adjacent the outlet of said container prior to exiting from said unit outlet.

53. The heated tank system of claim 49, wherein the inner end of each of said heat exchanger units is positioned in a plane below the outer end of said respective unit and wherein the oulet of said storage container is positioned at the inner ends of said units.

* * * * *